US009620878B2

(12) United States Patent
González González

(10) Patent No.: US 9,620,878 B2
(45) Date of Patent: Apr. 11, 2017

(54) RECEPTACLE ASSEMBLY OF NEMA PLUGS

(71) Applicant: SPANTIK, S.A., Panama (PA)

(72) Inventor: Vicente González González, Caracas (VE)

(73) Assignee: SPANTIK, S. A., Panama (PA)

( * ) Notice: Subject to any disclaimer, the term of this patent is extended or adjusted under 35 U.S.C. 154(b) by 0 days.

(21) Appl. No.: 14/955,719

(22) Filed: Dec. 1, 2015

(65) Prior Publication Data

US 2016/0276787 A1 Sep. 22, 2016

(30) Foreign Application Priority Data

Mar. 19, 2015 (MX) ..... MX/u/2015/000151

(51) Int. Cl.
*H01R 25/00* (2006.01)
*H01R 13/10* (2006.01)
*H01R 24/22* (2011.01)

(52) U.S. Cl.
CPC ..... *H01R 13/10* (2013.01); *H01R 24/22* (2013.01); *H01R 25/006* (2013.01)

(58) Field of Classification Search
CPC .. H01R 2103/00; H01R 31/06; H01R 31/065; H01R 27/02; H01R 23/025
USPC ..... 439/638, 215
See application file for complete search history.

(56) References Cited

U.S. PATENT DOCUMENTS 2,293,850 A * 8/1942 Robinson ..... H01R 25/164 174/101
2,457,831 A * 1/1949 O'Brien ..... H01R 25/164 174/126.1
2,579,538 A * 12/1951 Bierce ..... H01R 13/453 174/67
3,206,705 A * 9/1965 Smith ..... H01R 13/4534 439/137
3,222,631 A * 12/1965 Cohen ..... H01R 13/4534 174/67
3,238,492 A * 3/1966 Houston ..... H01R 13/4534 439/137
3,736,547 A * 5/1973 Koenig ..... H01R 13/453 439/137
4,493,517 A * 1/1985 Hillary ..... H01R 13/4534 439/137
4,544,219 A * 10/1985 Barkas ..... H01R 13/4534 439/137
4,579,410 A * 4/1986 Soloman ..... H01R 31/06 439/133
4,822,290 A * 4/1989 Cauley ..... H01R 13/4534 439/137

(Continued)

*Primary Examiner* — Abdullah Riyami
*Assistant Examiner* — Vladimir Imas
(74) *Attorney, Agent, or Firm* — Ladas & Parry LLP

(57) ABSTRACT

A receptacle assembly for NEMA plugs, comprising: a first pair of wires that run parallel to each other with a gap wide enough to form a first retention area; a second pair of wires that run parallel to each other with a gap wide enough to form a second retention area; a front face that includes two rows of fastening devices with two slots in each fastening device; wherein each wire in the first and second pair of wires is inserted into one of the slots of the fastening device of the front face, so that the first and second retention areas can receive a flat blade of the NEMA plug.

12 Claims, 6 Drawing Sheets

(56) References Cited

U.S. PATENT DOCUMENTS 5,236,370 A * 8/1993 King ..... H02G 3/288 439/171
5,252,086 A * 10/1993 Russell ..... H01R 25/00 439/152
5,513,998 A * 5/1996 Kim ..... H01R 31/06 439/170
5,523,529 A * 6/1996 Holliday ..... H02G 3/0418 138/163
6,247,941 B1 * 6/2001 Lee ..... H01R 13/652 439/103
6,323,421 B1 * 11/2001 Pawson ..... H02G 3/0418 174/503
6,335,484 B1 * 1/2002 Jarry ..... H02G 3/128 174/480
6,575,777 B2 * 6/2003 Henriott ..... H01R 25/162 439/215
6,592,406 B2 * 7/2003 Liu ..... H01R 13/6641 439/172
7,198,523 B2 * 4/2007 Adams ..... H01R 13/64 439/650
7,311,558 B2 * 12/2007 Adams ..... H01R 13/64 439/680
7,753,682 B2 * 7/2010 Gerard ..... H01R 13/652 439/13
8,152,554 B2 * 4/2012 Chapel ..... H01R 13/639 439/346
8,444,425 B2 * 5/2013 Byrne ..... H01R 4/185 439/215
8,496,491 B2 * 7/2013 Baek ..... H01R 13/71 200/51.09
8,496,492 B2 * 7/2013 Byrne ..... H01R 25/142 439/210
8,625,255 B2 * 1/2014 Linnane ..... H02G 3/0608 361/611
8,702,435 B2 * 4/2014 Tajima ..... H01R 13/4538 439/140
8,951,075 B2 * 2/2015 Ekchian ..... H01R 13/4538 439/170
8,963,378 B1 * 2/2015 Fornage ..... H01R 13/639 307/147
2005/0130476 A1 * 6/2005 Kochanski ..... H02G 3/00 439/215
2006/0052009 A1 * 3/2006 Johnson ..... H01R 12/592 439/660
2010/0068935 A1 * 3/2010 Chou ..... H01R 27/02 439/620.22
2010/0068945 A1 * 3/2010 Chou ..... H01R 13/514 439/701
2014/0126116 A1 * 5/2014 Irons ..... H05K 7/1492 361/622

* cited by examiner

RECEPTACLE ASSEMBLY OF NEMA PLUGS

BACKGROUND OF THE INVENTION

Duly embossed and folded bronze or brass plates are generally used in the manufacture of NEMA 1-15 and/or 5-15 plugs receptacles in order to achieve electrical connection and retention with the plug blades. Since the plug blades have different shapes and dimensions, specific metalwork designs are needed to connect each plug blade.

The widths of two of the flat blades in the NEMA 1-15 plug can be different in order to polarize them and guarantee their correct insertion, phase and neutral. This is another limitation or difficulty for the current technique to overcome, as the differential must be considered in the receptacle design.

For manufacturing multiple outlets, the metalwork must conduct the power among such outlets as well as comply with the standards of electrical retention and contact. The plates used in the manufacture of this metalwork must be embossed and folded to present the retention contacts along the different receptacles.

This invention proposes using rigid, circular cross-sectioned wires to simplify the manufacture of plug receptacles, with the advantage of eliminating the waste generated by the embossing procedure.

A second advantage of this invention is that it facilitates the insertion and disconnection of the plug blades.

A third advantage of this invention is that the circular cross-section of the wires allows to insert and disconnect the plugs with minor wear.

The characteristics of this invention are explained in the following description and the figures attached.

DESCRIPTION OF THE INVENTION

Figure 1:
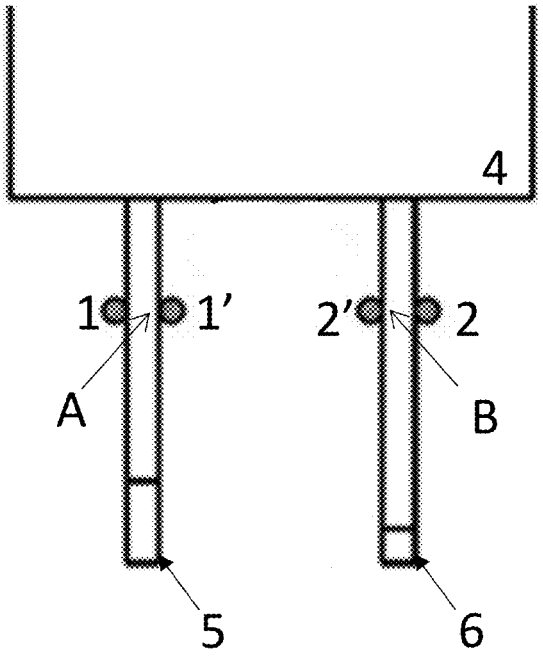
FIG. 1 is a sectional view of the invention wiring adapted to receive a NEMA 1-15 plug, excluding other elements of the invention to facilitate viewing the insertion of blades 5 and 6 into the A and B retention zones.

As seen in the possible embodiment of the invention adapted to receive a NEMA 1-15 plug (polarized or non-polarized) shown in FIG. 1, the receptacle includes four straight wires that run parallel to each other. The wires have a circular cross-section and are manufactured with a material that facilitates or permits electrical conductivity. The wires are preferably made of copper or copper alloys, like brass or bronze. The tension required to ensure retention of the plugs during powering with a power strip, outlet, or the like, including the invention receptacle while facilitating the insertion and disconnection of the NEMA (1-15 and/or 5-15) plug blades, is achieved through the elastic properties of the wire, which in this case is made of copper, brass, bronze, or a similar alloy. The hardness degree of the wire material must preferably be from HALF-HARD to HARD. As an option, the wires may be nickel- or tin plated to extend their durability in moist or corrosive environments.

Figure 2:
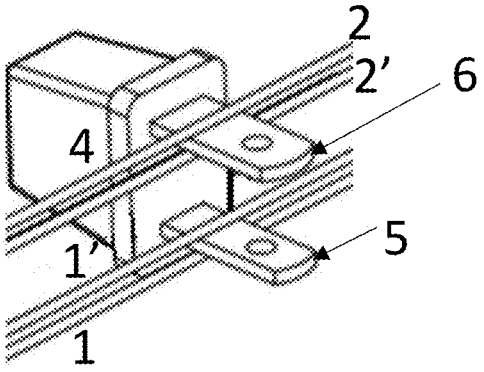
FIG. 2 is a perspective view of FIG. 1 assembly.

In FIG. 1 assembly, the wires were set up to form two retention areas for the flat blades of the NEMA 1-15 plug (polarized or non-polarized) once the plug is inserted into the power strip or outlet that receives the invention receptacle. Each area is limited by a pair of wires that run parallel to each other. The first retention area A is limited by a first pair of wires 1 and 1'. The second retention area B is limited by a second pair of wires 2 and 2'. When the plug is connected to a receptacle of the invention, blades 5 and 6 of plug 4 are inserted into retention areas A and B, respectively. FIG. 2 shows a perspective view of FIG. 1 assembly.

The pairs of wires 1-1' and 2-2' are separated by a gap that allows the insertion of blades 5 and 6 of plug 4 into retention areas A and B. This gap is equal to or slightly smaller than the width of blades 5 and 6. In general, the gap between the pairs of wires 1-1' and 2-2' ranges from 1.0 mm to 1.65 mm. The gap between the pairs of wires 1-1' and 2-2' should preferable measure 1.2 mm to 1.65 mm. This gap is wide enough to allow the insertion of the NEMA 1-15 plug blades and ensure their retention because of elements 8 (see FIG. 5), which fixate the wires on both sides and to a certain distance of the blade insertion area.

The round profile of the wires facilitates the insertion and disconnection of the NEMA (1-15 and/or 5-15) plug blades while simultaneously ensuring adequate contact for the correct power transmission between blades 5 and 6 and the first pair of wires 1 and 1', and the second pair of wires 2 and 2'.

Figure 3:
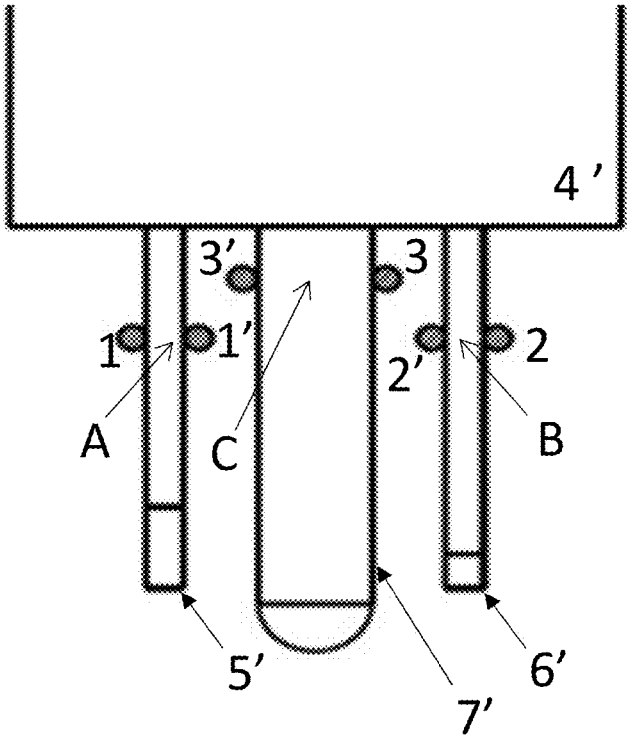
FIG. 3 is a sectional view of the invention wiring adapted to receive a NEMA 5-15 plug, excluding other elements of the invention to facilitate viewing the insertion of blades 5', 6', and 7' into the A, B, and C retention zones.

FIG. 3 shows a possible embodiment of the invention receptacle adapted to NEMA 5-15 plugs. This figure shows a third pair of wires 3 and 3' placed between the first pair of wires 1 and 1' and the second pair of wires 2 and 2'. The shape (circular cross-section) and materials of wires 3 and 3' meet the specifications of wires 1 and 1', and 2 and 2' described above. FIG. 3 wires were set up to form three retention areas for the NEMA 5-15 plug blades. Each area is limited by a pair of wires that run parallel to each other. The first retention area A is limited by a first pair of wires 1 and 1';the second retention area B is limited by a second pair of wires 2 and 2'; and the third retention area C is limited by a third pair of wires 3 and 3'. Blades 5', 6', and 7' of plug 4 are inserted into the A, B, and C retention zones, respectively.

Figure 4:
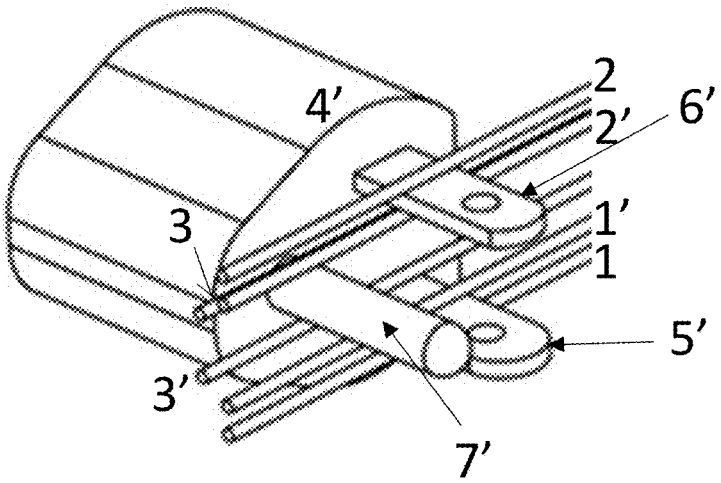
FIG. 4 is a perspective view of FIG. 3 assembly.

FIG. 4 shows a perspective view of FIG. 3 assembly. The 1-1' and 2-2' wire pairs are separated by a gap similar to the gap described above for the embodiment of FIG. 1. Likewise, the gap between the wires 3 and 3' allows inserting the central blade 7' of the NEMA 5-15 plug into retention area C. This gap is equal to or slightly smaller than the width of blade 7'. In general, the gap between the pairs of wires 3-3' ranges between 4.0 mm and 4.83 mm, though the gap between the pairs of wires 3-3' should preferably range between 4.17 mm and 4.83 mm. The round profile of the wires facilitates the insertion and disconnection of the NEMA (1-15 and/or 5-15) plug blades, thus constantly ensuring the adequate contact for a correct power transmission between blades 5', 6', and 7' and the wires 1 and 1', 2 and 2', and 3 and 3', respectively.

Figure 5:
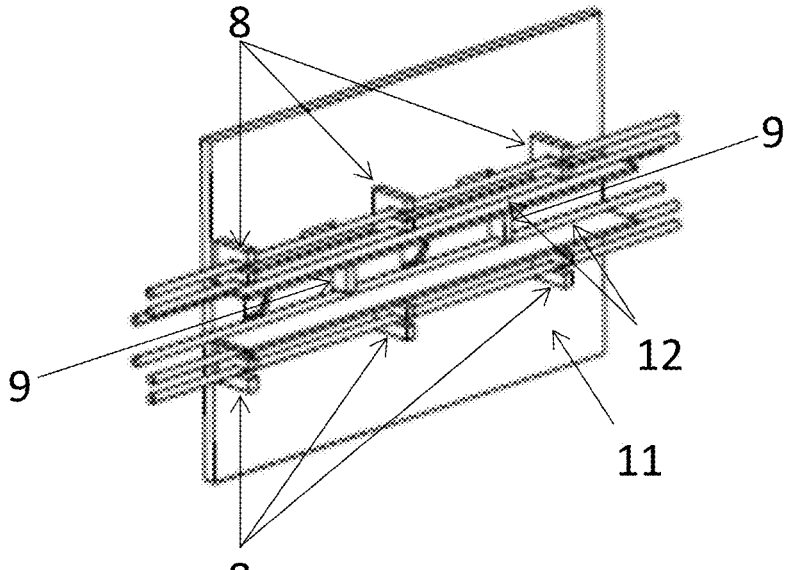
FIG. 5 is a perspective view of the front face of the receptacle assembly according to the invention.
Figure 6:
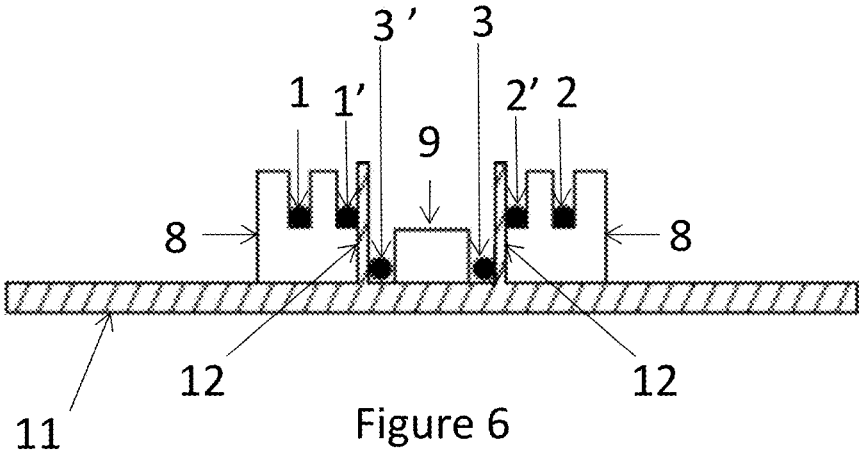
FIG. 6 is a sectional view of the front face of FIG. 5.
Figure 11:
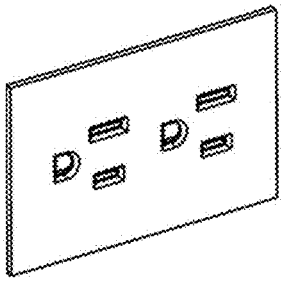
FIG. 11 is a possible embodiment of the front face of the invention assembly, which presents two NEMA 5-15 plugs for reference purposes.
Figure 12:
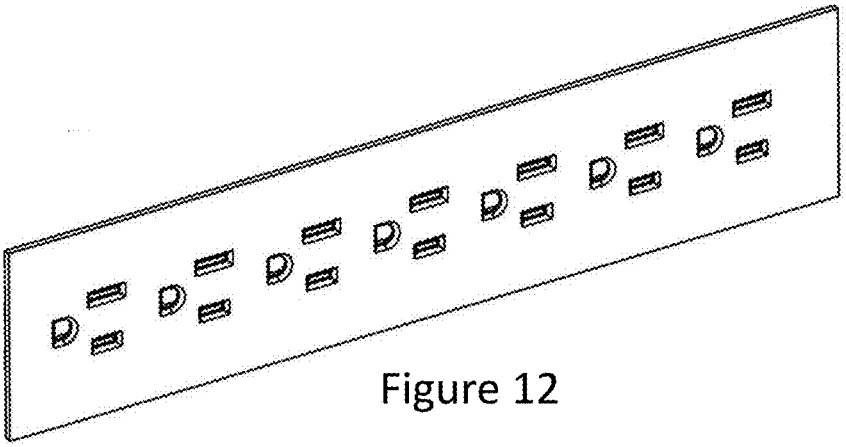
FIG. 12 is a possible embodiment of the front face of the invention assembly, which presents seven NEMA 5-15 plugs for reference purposes.

The invention receptacle also includes structures inside the power strip, outlet, or the like (hereinafter referred to as "outlet set" to facilitate description) that help fix the wires 1, 1', 2, 2', 3, and 3' while allowing such wires to bend when they receive a plug blade and return to their original form when the blade is removed. As a reference, FIGS. 5 and 6 show the fastening device of the front face 11 of the receptacle assembly 10. In this case, the front face 11 includes two power outlets, and the fastening devices are represented by two rows that include three fastening devices 8 per row. The minimum requirement of fastening devices 8 is two per each outlet. The number of fastening devices 8 required to manufacture a power strip with a determined number n of outlets corresponds to 2n+2. For example, for the embodiment of FIG. 11, the invention assembly should include six fastening elements 8 (three in each row as shown in FIG. 5); for the embodiment shown in FIG. 12, the assembly should include sixteen fastening elements 8 (eight in each row). Likewise, the front face 11 includes central fastening elements 9. As seen in FIGS. 5 and 6, wires 1, 1', 2, and 2' will be fixed into one of the two slots inside the fastening element 8, thus avoiding contact between each of the wires 1-1' and 2-2'. 3-3' wires are fixed and separated from each other by the central fastening elements 9. The power outlet set may have a minimum of one central fastening element 9 between the 3 and 3' wires. However, more elements 9 can be added depending on the length of the outlet set. Elements 9 are preferably placed evenly apart from blade 7' and two are used for each power outlet. The physical gap between the 1'-3' and 3-2' wires is secured by two extensions 12 of the front face 11, which can be extended along the body of element 11 (as shown in FIG. 5) or discontinuously in one or several sections along the front face 11.

Figure 7:
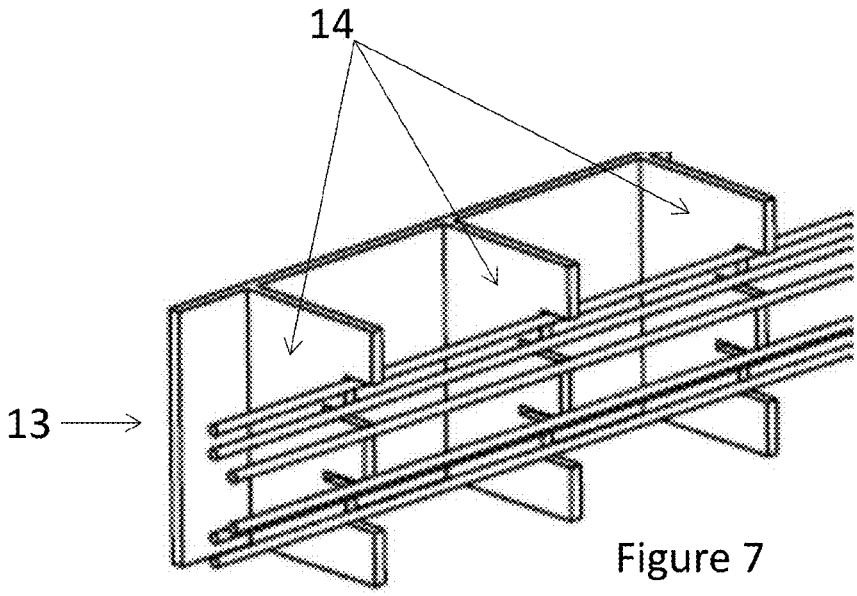
FIG. 7 is a perspective view of the back body of the receptacle assembly according to the invention. For reference purposes, this Figure includes the same wiring used to describe FIG. 5 according to the invention.
Figure 8:
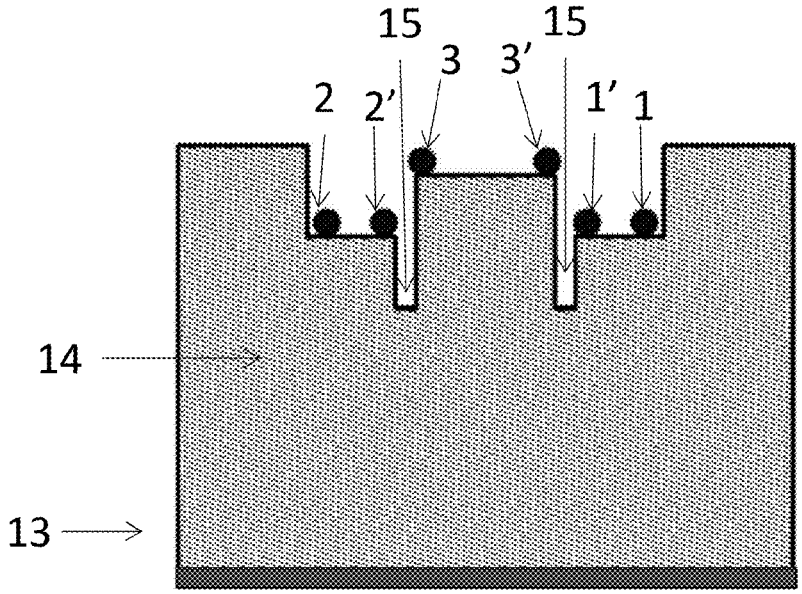
FIG. 8 is a sectional view of the back body in FIG. 7.
Figure 9:
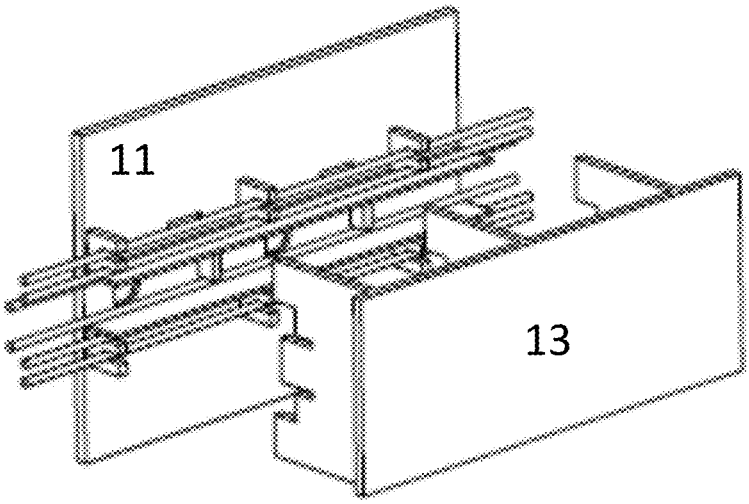
FIG. 9 is a perspective view of a receptacle according to the invention before connecting the front face and the back body and showing the inner wiring.
Figure 10:
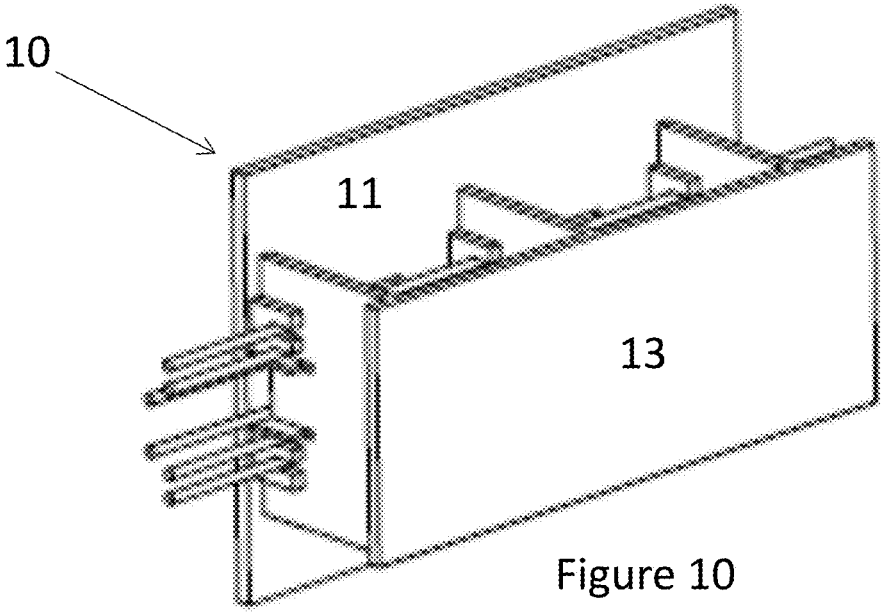
FIG. 10 is a perspective view of a receptacle according to the invention with the front face and back body in the receptacle assembly in their final assembly position.

The invention can additionally include fastening devices as shown in FIG. 7. These fastening devices are represented by three extensions 14 of the back body 13 of the receptacle assembly 10. FIG. 8 shows a sectional view of element 13 of FIG. 7. When included, the fastening devices 14 are additional to the fastening devices 8 and 9 of the front face 11. Fastening devices 14 include two slots 15 with the appropriate shape and dimensions to receive extensions 12 of the front face 11.

In order to power the device, power strip, extension, or device joined or connected to a type 4 plug in FIG. 1 or type 4' in FIG. 3, wires 1, 1', 2, 2', 3, and 3' must be connected directly to a power source. For example, in case the invention is installed in a wall outlet, the power source includes the internal connections that supply current to the rest of the home. In case the invention is installed inside a power strip, the power will be supplied by an external source where the strip is connected; for example, a power outlet that includes or does not include a receptacle of this invention. Regardless of the device, power strips, outlets, or the like, where the present invention receptacle is installed, the wires will be fixed to their positions inside said device using insulating materials like plastic or insulating resins.

This description is intended to present the invention with reference purposes and should in no way be construed so as to limit or restrict the claimed invention. Likewise, the drawings presented are referential representations to clarify the principles supporting the invention and the contributions regarding the technique status.

The invention claimed is:

1. A receptacle assembly for NEMA plugs, comprising:
- a first pair of wires that run parallel to each other with a gap wide enough to form a first retention area;
- a second pair of wires that run parallel to each other with a gap wide enough to form a second retention area;
- a front face that includes two rows of fastening devices with two slots in each fastening device;

wherein each wire in the first and second pair of wires is inserted into one of the slots of the fastening device of the front face so that the first and second retention areas can receive a flat blade of the NEMA plug.

2. The receptacle assembly of claim 1, wherein the number of fastening devices equals 2n+2, n being the number of outlets included in the set.

3. The receptacle assembly of claim 2, wherein the gap between the wires in the first pair of wires and the gap between the wires in the second pair of wires range from 1.00 mm to 1.65 mm.

4. The receptacle assembly of claim 3, wherein the gap between the wires in the first pair of wires and the gap between the wires in the second pair of wires range from 1.2 mm to 1.65 mm.

5. The receptacle assembly of claim 4, further comprising a third pair of wires that run parallel to each other with a gap wide enough to form a third retention area, wherein said third pair of wires is placed between the first and the second pair of wires.

6. The receptacle assembly of claim 5, further comprising a front face with additional central fastening devices between the wires in the third pair of wires.

7. The receptacle assembly of claim 6, wherein the gap between the wires in the third pair of wires ranges from 4.00 mm to 4.83 mm.

8. The receptacle assembly of claim 7, wherein the gap between the wires in the third pair of wires ranges from 4.17 mm to 4.83 mm.

9. The receptacle assembly of claim 8, wherein the wires are made of copper or a copper alloys.

10. The receptacle assembly of claim 9, wherein the wires are made from materials with a hardness degree that ranges from HALF-HARD to HARD.

11. The receptacle assembly of claim 10, wherein the wires are nickel or tin plated.

12. The receptacle assembly of claim 9, wherein the copper alloy is brass or bronze.

* * * * *